US011385600B2

(12) United States Patent
Nagareda et al.

(10) Patent No.: US 11,385,600 B2
(45) Date of Patent: Jul. 12, 2022

(54) TIMER MEASUREMENT DEVICE, ELECTRONIC TIMEPIECE, TIMER MEASUREMENT METHOD, AND NON-TRANSITORY COMPUTER READABLE STORAGE MEDIUM STORING PROGRAM

(71) Applicant: CASIO COMPUTER CO., LTD., Tokyo (JP)

(72) Inventors: Hirofumi Nagareda, Tachikawa (JP); Shigeki Hisada, Mitaka (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 797 days.

(21) Appl. No.: 16/251,661

(22) Filed: Jan. 18, 2019

(65) Prior Publication Data

US 2019/0243310 A1 Aug. 8, 2019

(30) Foreign Application Priority Data

Feb. 8, 2018 (JP) ..... JP2018-020606

(51) Int. Cl.
*G04F 1/00* (2006.01)
*G04G 15/00* (2006.01)
*G04F 3/06* (2006.01)

(52) U.S. Cl.
CPC ..... *G04F 1/005* (2013.01); *G04F 3/06* (2013.01); *G04G 15/003* (2013.01)

(58) Field of Classification Search
CPC ..... G04F 1/005; G04F 3/06; G04G 15/003
See application file for complete search history.

(56) References Cited

U.S. PATENT DOCUMENTS 4,337,529 A * 6/1982 Morokawa ..... A61B 5/02438 331/113 R
6,358,188 B1 * 3/2002 Ben-Yehuda ..... A63B 24/00 482/8

(Continued)

FOREIGN PATENT DOCUMENTS

JP S5640782 A 4/1981
JP H0972973 A 3/1997

(Continued)

OTHER PUBLICATIONS

Japanese Office Action (and English translation thereof) dated Dec. 7, 2021, issued in counterpart Japanese Application No. 2018-020606.

*Primary Examiner* — Edwin A. Leon
*Assistant Examiner* — Jason M Collins
(74) *Attorney, Agent, or Firm* — Holtz, Holtz & Volek PC

(57) ABSTRACT

A timer measurement device includes a signal output unit, an operation input unit and a processor. The processor stores ordered time settings including at least respective timer values. When an elapsed time that is measured by using a clock signal output by the signal output unit reaches a timer value of a time setting selected from the time settings, the processor resets the elapsed time, and switches the selected time setting to a next time setting among the ordered time settings. If the operation input unit receives a predetermined change command during, the measurement of the elapsed time for the timer value of the selected time setting, the processor performs, in response to the change command, a change processing which changes a remaining time with respect to the elapsed time for the timer value of the selected time setting.

19 Claims, 5 Drawing Sheets

(56) References Cited

U.S. PATENT DOCUMENTS

| | | | | |
|---|---|---|---|---|
| 6,796,925 | B2 * | 9/2004 | Martinez | A63B 24/00 482/1 |
| 2003/0206496 | A1 * | 11/2003 | Neilly | G04F 10/00 368/108 |
| 2012/0075959 | A1 * | 3/2012 | Keith | G04F 3/08 368/11 |
| 2012/0287758 | A1 * | 11/2012 | Lin | G04G 21/04 368/47 |
| 2014/0239740 | A1 * | 8/2014 | Stellwag | G04C 23/50 307/116 |
| 2015/0309480 | A1 * | 10/2015 | Patton | G04F 1/005 368/109 |

FOREIGN PATENT DOCUMENTS

| | | | |
|---|---|---|---|
| JP | H09145863 | A | 6/1997 |
| JP | 2014048238 | A | 3/2014 |
| JP | 2014126393 | A | 7/2014 |
| JP | 2015184254 | A | 10/2015 |

* cited by examiner

| | | |
|---|---|---|
| 1 | WORK-A | 0:01:20 |
| 2 | WORK-B | 0:00:35 |
| 3 | WORK-C | 0:00:35 |
| 4 | WORK-D | 0:00:35 |
| 5 | REST | 0:01:25 |
| SUBTOTAL | | 0:04:30 |
| NUMBER OF CYCLES | | 15 |
| TOTAL | | 1:07:30 |

| CYCLE | SETTING NUMBER | TIME |
|---|---|---|
| 1 | 3 | 0:00:21 |
| 2 | 1 | 0:01:30 |
| | | |
| | | |

TIMER MEASUREMENT DEVICE, ELECTRONIC TIMEPIECE, TIMER MEASUREMENT METHOD, AND NON-TRANSITORY COMPUTER READABLE STORAGE MEDIUM STORING PROGRAM

CROSS-REFERENCE TO RELATED APPLICATIONS

This application is based upon and claims the benefit of priority under 35 U.S.C. 119 of Japanese Patent Application No. 2018-020606 filed on Feb. 8, 2018 the entire disclosure of which, including the description, claims, drawings, and abstract, is incorporated herein by reference in its entirety.

BACKGROUND

1. Field of the Invention

This disclosure relates to a timer measurement device, an electronic timepiece, a timer measurement method, and a non-transitory computer readable storage medium storing a program(s).

2. Description of Related Art

There is a timer measurement device which measures and displays a timer value, calculates the remaining time from the measured time of the timer value, displays the remaining time, and performs notification processing when the timer value has passed. As an example of the timer measurement device, there is a timer measurement device having a function of measuring two or more timer values in order, or a function of measuring one or more timer values for a plurality of cycles. (Refer to, for example, JP 2014-126393 A.)

However, while a timer value(s) is being measured multiple times, it may be desired to change the set time(s) (timer value(s)). Conventionally, such adjustment cannot be easily performed during the measurement.

SUMMARY

In order to achieve at least one of the objects, according to an aspect of the following embodiments, there is provided a timer measurement device including: a signal output unit which outputs a clock signal of a predetermined frequency; an operation input unit which receives an input operation; and a processor which: stores ordered time settings including at least respective timer values; when an elapsed time that is measured by using the clock signal reaches a timer value included in a time setting selected from the time settings, resets the elapsed time, and switches the currently selected time setting to a next time setting among the ordered time settings; and when the operation input unit receives a predetermined change command during the measurement of the elapsed time for the timer value of the currently selected time setting, performs, in response to the change command, a change processing which changes a remaining time with respect to the elapsed time for the timer value of the currently selected time setting.

BRIEF DESCRIPTION OF THE DRAWINGS

The accompanying drawings, which are incorporated in and constitute apart of the specification, illustrate embodiments of the invention, and together with the general description given above and the detailed description of the embodiments given below, serve to explain the principles of the invention, wherein.

DETAILED DESCRIPTION

Hereinafter, one or more embodiments will be described on the basis of the drawings.

Figure 1:
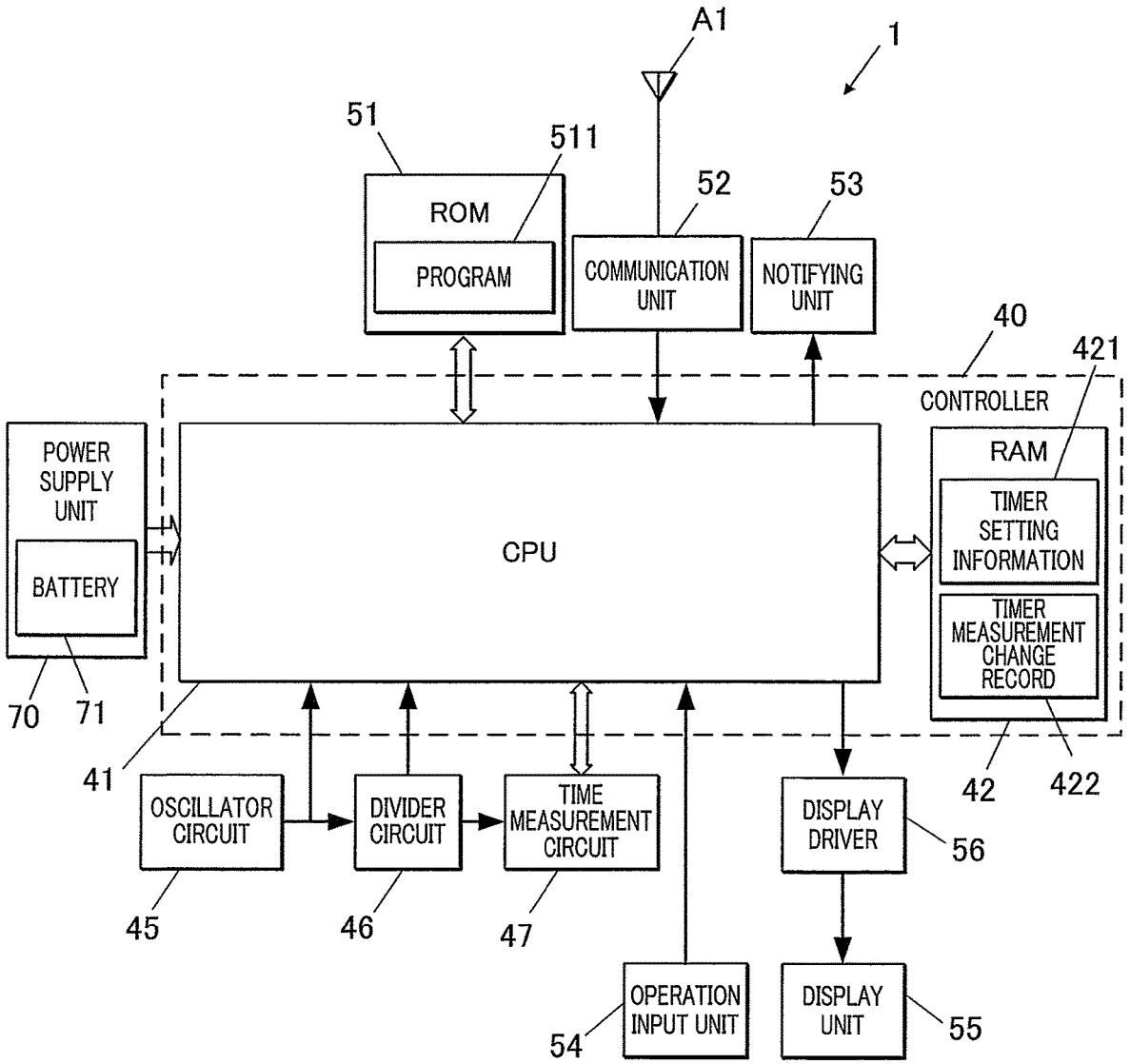
FIG. 1 is a block diagram showing functional configuration of an electronic timepiece according to an embodiment(s) of the following embodiments.

FIG. 1 is a block diagram showing functional configuration of an electronic timepiece 1 as a timer measurement device (computer) of an embodiment(s).

The electronic timepiece 1 is an electronic timepiece (computer), such as an electronic watch, which is used mainly by being carried by a user.

The electronic timepiece 1 includes a controller 40, an oscillator circuit 45, a frequency divider circuit 46, a time measurement circuit 47 (time measurement unit), a read only memory (ROM) 51, a communication unit 52 and an antenna A1 therefor, a notifying unit 53, an operation input unit 54, a display unit 55 and a display driver 56 therefor, and a power supply unit 70.

The controller 40 is a processor which includes a central processing unit (CPU) 41 and a random access memory (RAM) 42, and collectively controls overall operation of the electronic timepiece 1.

The CPU 41 performs various types of arithmetic processing, and controls operation of each component of the electronic timepiece 1. The controller 40 controls operation including a stopwatch function and a timer function.

The RAM 42 provides the CPU 41 with a memory space for work, and stores various temporary data and overwritable/updatable setting data. The RAM 42 includes timer setting information 421 and a timer measurement change record 422 which are used in the timer function.

The timer setting information 421 includes information (time settings or timer settings) on timer values for timer measurement obtained on the basis of input operations received by the operation input unit 54, or obtained by the communication unit 52 from an external device, such as a smartphone.

Each timer value is a numerical value of time which elapsed time that is measured by the time measurement circuit 47 should reach. In this embodiment, the elapsed time is measured with a time resolution which can accurately identify the elapsed time reaching the timer value. Each time setting includes at least a timer value, and may also include identification information on a type of training, a rest or the like (which hereinafter may be referred to as "task") which is set for the timer value.

The timer measurement change record 422 includes, as described below, records of changed contents if settings are changed during timer measurement processing.

The oscillator circuit 45 outputs an oscillator signal of a predetermined frequency of, for example, about 32 kHz. The oscillator circuit 45 is not particularly limited, but may include a crystal oscillator which is small, low cost and low power consumption, and does not have a temperature compensation circuit.

The frequency divider circuit 46 divides the oscillator signal to generate a clock signal of a necessary frequency (predetermined frequency), and outputs the same. The frequency divider circuit 46 properly changes a frequency division ratio in response to a control signal from the CPU 41, and consequently can output signals of different frequencies.

The oscillator circuit 45 and the frequency divider circuit 46 constitute a signal output unit of the electronic timepiece 1 (timer measurement device) of this embodiment.

The time measurement circuit 47 measures, on the basis of the clock signal of the predetermined frequency input from the frequency divider circuit 46, the current date and time by adding the elapsed time to a set date and time obtained from a not-shown real time clock (RTC) or the like. The date and time measured by the time measurement circuit 47 is rewritable/correctable in response to a control signal from the CPU 41 on the basis of current-date-and-time data or the like obtained from the outside via the communication unit 52.

The oscillator circuit 45, the frequency driver circuit 46 and the time measurement circuit 47 may be formed on a single microcomputer chip together with the controller 40. Alternatively, the crystal oscillator of the oscillator circuit 45, the RAM 42 and so forth may be attached to a microcomputer.

The ROM 51 stores various programs 511 and the setting data for the electronic timepiece 1 to perform various types of operation. The programs 511 include a control program for the timer measurement processing. As the ROM 51, in addition to or instead of a mask ROM, a rewritable/updatable one, such as an electrically erasable and programmable read only memory (EEPROM) or a flash memory, may be used.

The communication unit 52 communicates with external devices. In this embodiment, as a communication system, near field communication, such as Bluetooth®, is used. The controller 40 sends/receives information to/from external devices via the communication unit 52 and the antenna A1. The external devices are preset as connectable devices, and these settings are stored in the RAM 42 or the like.

The notifying unit 53 performs notification processing under the control of the CPU 41 (controller 40). Examples of its component which performs the notification processing include an electronic circuit which outputs beep sound, a weight-attached motor which generates vibrations, and a light emitting diode (LED) lamp which emits light.

The operation input unit 54 receives input operations from the outside. The operation input unit 54 includes a plurality of operation keys and/or push-button switches, and when these operation keys and/or push-button switches are operated (i.e., operation s are performed thereon), converts the operation s into electric signals, and outputs the signals to the CPU 41 (controller 40) as input signals. The operation input unit 54 may include a crown, a touch sensor, and/or the like in addition to or instead of the operation keys and/or the push-button switches.

The display unit 55 has a display screen, and displays various types of information, such as date-and-time information, in response to drive signals from the display driver 56. The display screen is not particularly limited, but may be a segmented liquid crystal display (LCD). The display screen may be configured to display a receiving mark indicating that communications via the communication unit 52 are being performed, and other indicators indicating that functions, which are various, are being performed. The electronic timepiece 1 may be an analog hand type having, as the display unit 55, multiple hands and stepping motors which rotate the hands, and displaying the date-and-time information and so forth by the hands indicating points, or may be a type using both hand display and digital display.

The power supply unit 70 includes a battery 71, and supplies, from the battery 71, power with a predetermined voltage necessary for each component of the electronic timepiece 1 to operate. As the battery 71, for example, an attachable/detectable button-type primary cell is used. Alternatively, the power supply unit 70 may include a solar panel and/or a storage battery (rechargeable battery) which accumulates power generated by the solar panel.

Next, the timer measurement processing in the electronic timepiece 1 of this embodiment will be described.

Figures 2A, 2B:
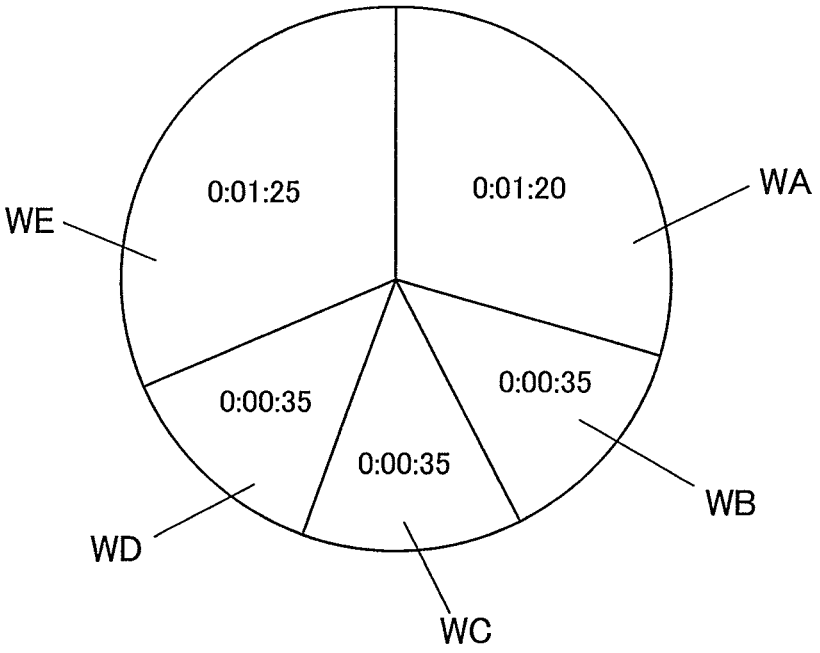
FIG. 2A is a diagram to explain timer measurement processing.
FIG. 2B is a diagram to explain the timer measurement processing.

FIG. 2A and FIG. 2B are diagrams to explain the timer measurement processing.

In the electronic timepiece 1, two or more timer values used in the timer measurement are set.

In this embodiment, the time settings which include their respective timer values are set. Hence, the number of the time settings are the same as the number of the timer values (two or more).

The electronic timepiece 1 continuously selects and measures (the elapsed time for) the timer values in order.

When the elapsed time being measured reaches a value which is the same as a currently selected timer value, the notifying unit 53 performs the notification processing.

As shown in FIG. 2A, in this embodiment, as the time settings, which include the timer values, five time settings WA to WE are ordered and set.

If the time setting WA is selected first, after one minute 20 seconds, which corresponds to the time setting WA, elapses from the start of the measurement of the elapsed time, the notification processing is performed, and at the same time, the measurement for 35 seconds, which corresponds to the next time setting WB, is started.

Then, after 35 seconds elapses, namely, after one minute seconds from the start of the measurement, the next notification processing is performed.

Similarly, in the order of the time settings WA to WE and in accordance with their respective timer values, each of: after two minutes 30 seconds, which is 35 seconds after one minute 55 seconds; after three minutes five seconds, which is 35 seconds after two minutes 30 seconds; and after four minutes 30 seconds, which is one minute 25 seconds after three minutes five seconds, the notification processing is performed.

The electronic timepiece 1 can keep measuring the elapsed time for a plurality of cycles, taking the time settings WA to WE as a cycle.

That is, after the measurement for the timer value of the time setting WE (after four minutes 30 seconds from the start of the measurement of the elapsed time), the measurement for the timer value of the time setting WA may be started again Without a break.

These five (two or more) time settings and a setting of the number of cycles are stored in the RAM 42 (memory) as the timer setting information 421 as shown in FIG. 2B.

The timer setting information 421 may be set in response to input operations received by the operation input unit 54 of the electronic timepiece 1.

Alternatively, setting data on time settings generated by an external device, such as a smartphone, with a predetermined application program may be obtained via the communication unit 52, and the obtained setting data may be stored as the timer setting information 421.

If some of the time settings are changed by an external device, the external device detects the updated time settings) and sends only the detected time setting(s) to the electronic timepiece 1, and in the electronic timepiece 1, only the time setting(s) in the timer setting information 421 corresponding to the received time setting(s) is updated.

Although not particularly limited, in this embodiment, the timer setting information 421 is updatable anytime (storing step or storing process), and between when one timer measurement is stopped or finished and when new (next) timer measurement is started, the latest (most recent) information is read and used as temporary data.

In this embodiment, for the time settings WA, WB, WC, WD and WE, their respective names "Work-A", "Work-B", "Work-C", "Work-D" and "Rest" are set as the identification information in setting numbers "1", "2", "3", "4" and "5", respectively.

The controller 40 causes the notifying unit 53 to perform different types of the notification processing for the respective names (identification information).

Examples of the different types of the notification processing include different patterns and different time lengths of beep sound, different patterns and different time lengths of vibrations, and different patterns and different time lengths of light emission from the LED. Because multiple types of the notification processing are available, different types of the notification processing can be performed for different names. Note that the same name may be set for different setting numbers.

Further, the timer setting information 421 may be updated by only the name(s) being changed.

The names may be set by being selected only from a predetermined list, or may be set freely by a user.

A correspondence relationship between the names and the types of the notification processing may be set by a user. Alternatively, the names and the types of the notification processing may be automatically assigned one another in a predetermined order by the controller 40.

The names (identification information) do not always need to be set or stored.

In this timer setting information 421, as the number of cycles (the number of measurement cycles), "15 (times)" is set. That is, if the measurement of the elapsed time is started on the basis of this setting, the measurement for the time settings WA to WE of one cycle, which takes four minutes 30 seconds, is repeated 15 times, and the measurement is performed for one hour seven minutes 30 seconds in total accordingly.

When the measurement of the elapsed time for 15 times/cycles finishes, the measurement of the elapsed time automatically finishes.

In the electronic timepiece 1, in such a case, namely, in the case where the elapsed time is measured for a plurality of cycles each of which is constituted of two or more time settings combined, during the measurement, in addition to suspension (temporary stop) and a (full) stop of the measurement, change processing can be performed in response to a predetermined input operation(s) (predetermined change command(s)) received from the outside. The change processing is processing which changes the remaining time with respect to the elapsed time being measured, for example, by skipping the measurement for some or a part of the timer values(s) or by changing a timer value(s).

Figures 3A, 3B:
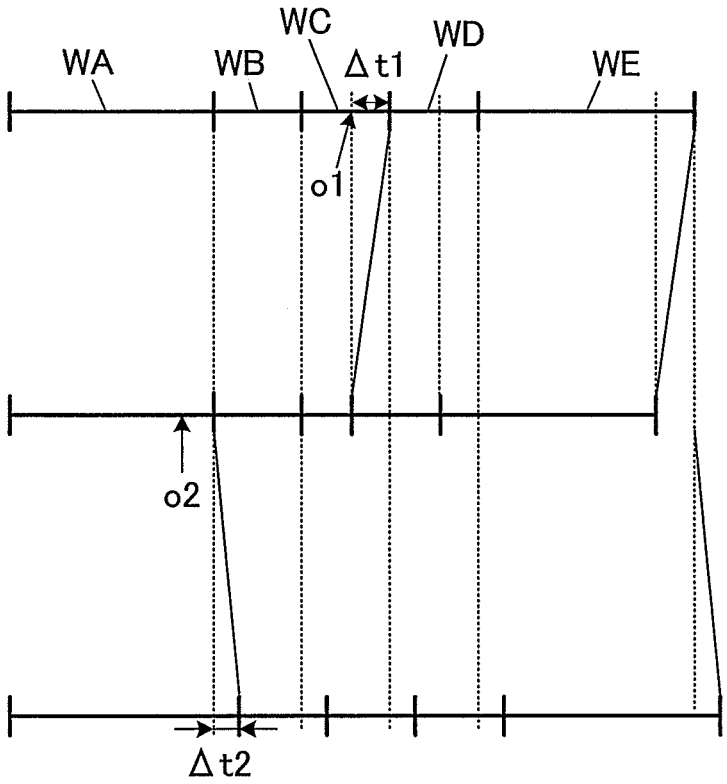
FIG. 3A is a diagram to explain, using examples, how a timer value(s) being measured is changed.
FIG. 3B is a diagram to explain, using the examples, how the timer value being measured is changed.

FIG. 3A and FIG. 3B are diagrams to explain, using examples, how the timer value(s) being measured is changed.

As shown in FIG. 3A, during the measurement of the elapsed time for the time settings of WA to WE which constitute a cycle, if a measurement skip command (first change command) is obtained at a timing of during the measurement for the timer value of the time setting WC, the measurement of the remaining time t1 in the time setting WC is skipped, and the measurement for the timer value of the next time setting WD is started. That is, when a skip command is obtained, a process of changing a value of the remaining time Δt1 to zero, thereby reducing the timer value of the time setting WC by a time length which is equal to the remaining time Δt1 at the timing of obtaining the skip command, is performed.

This reduction in the time setting WC by the remaining time Δt1 may be effective in this one cycle only, or may be effective in every following cycle too, namely, when this time setting is performed again (i.e., when a time setting is switched to this time setting again). A record about the skipped time is stored in the timer measurement change record 422.

Further, if a timer value change command (second change command) is obtained at a timing o2 during the measurement for the timer value of the time setting WA, the timer value of the time setting WA is extended by time t2 (predetermined time) in this example.

Extension and reduction of a timer value may be switched according to the type of a push-button switch or how to operate a push-button switch, for example, by pressing a push-button switch twice within a predetermined time.

By performing an operation multiple times, the operation corresponding to a command to extend or reduce a timer value by the time Δt2, time to add to or subtract from the timer value can be changed in units of the time Δt2.

The extension (or reduction) of the timer value of the time setting WA does not change (affect) the other time settings WE to WE, but changes a cycle time (subtotal time) of this cycle.

This extension (or reduction) of the timer value of the time setting WA by the time Δt2 may be effective in this one cycle only, or may be effective in every following cycle too, namely, when this time setting is performed again (i.e., when a time setting is switched to this time setting again).

Thus, if the remaining time in a timer value is skipped, or a timer value is changed, such a change timing and a timer value after being changed are stored in the timer measurement change record 422. In the case of the above examples, as shown in FIG. 3B, it is recorded that a skip was made in the setting number "3", namely, the time setting WC, of the first cycle when 21 seconds had been counted (14 seconds left) for the timer value of 35 seconds, and it is also recorded that the timer value of one minute 20 seconds was extended by 10 seconds, thereby being one minute 30 seconds, in the setting number "1", namely, the time setting WA, of the second cycle.

Figure 4:
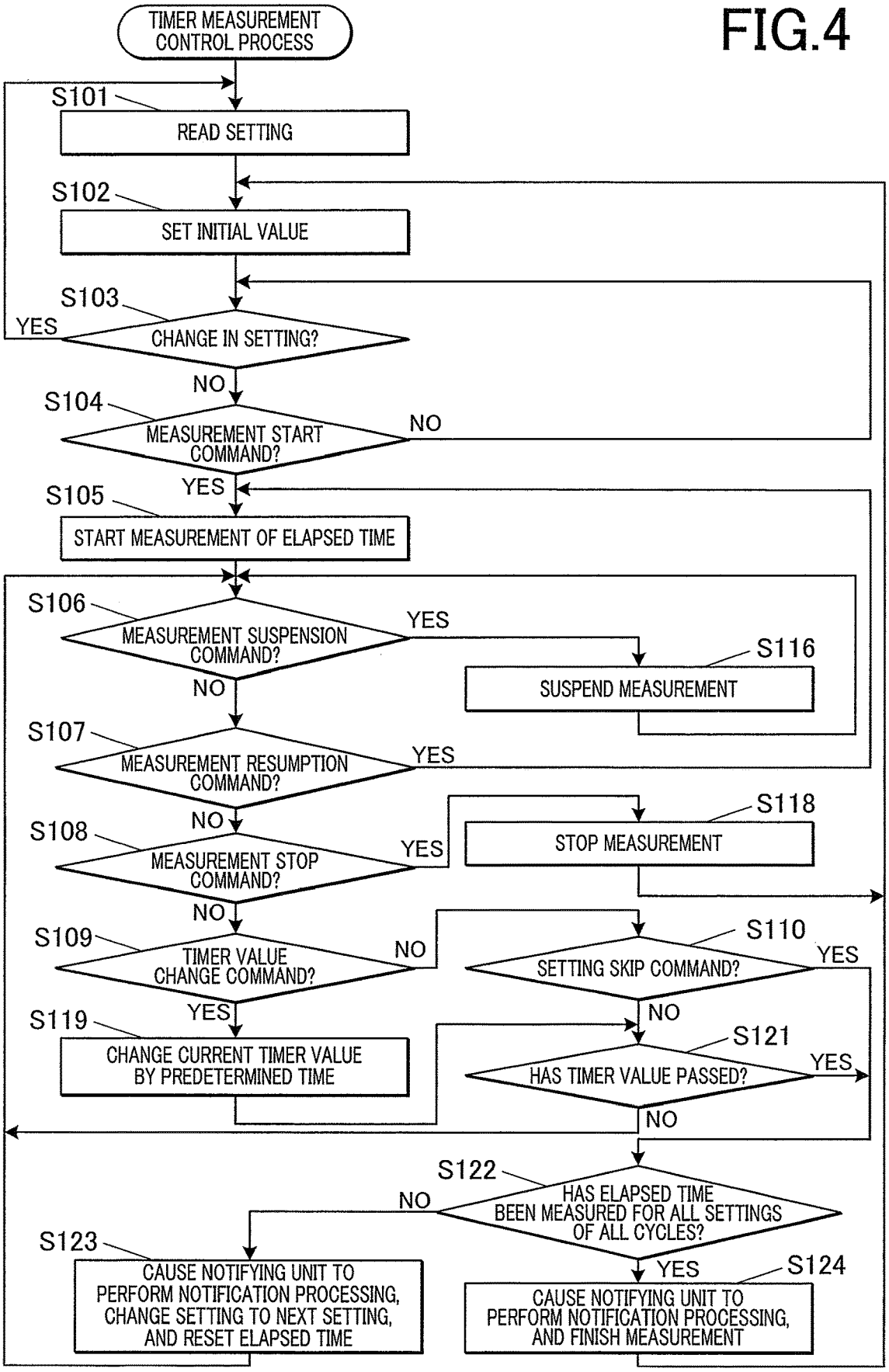
FIG. 4 is a flowchart showing a control procedure of a timer measurement control process.

FIG. 4 is a flowchart showing a control procedure by the controller 40 in a timer measurement control process performed in the electronic timepiece 1 of this embodiment.

When the electronic timepiece 1 starts up, the timer measurement control process becomes active, and while the electronic timepiece 1 is in operation, this process repeats continuously. That is, the timer measurement processing continues no matter whether display settings on the display unit 55 of the electronic timepiece 1 are display settings for contents of the timer measurement or not.

When the timer measurement control process is started (activated), the controller 40 (CPU 41) refers to the timer setting information 421, and reads timer settings (i.e. time settings) (Step S101). The controller 40 sets the timer value of the first timer setting as an initial value and as a measurement target time (the timer value of the currently selected time setting) (Step S102).

The controller 40 determines whether change in the time settings has been obtained (Step S103). That is, the controller 40 determines whether the timer setting information 421 has been rewritten. When determining that the change has been obtained, namely, the timer setting information 421 has been rewritten (Step S103: YES), the controller 40 returns to Step S101.

On the other hand, when determining that the change has not been obtained (Step S103: NO), the controller 40 determines whether a measurement start command to start measurement of the elapsed time has been obtained (Step S104). When determining that the measurement start command has not been obtained (Step S104: NO), the controller 40 returns to Step S103. On the other hand, when determining that the measurement start command has been obtained (Step S104; YES), the controller 40 starts the measurement of the elapsed time (Step S105).

Next, the controller 40 determines whether a measurement suspension command to suspend the measurement of the elapsed time has been obtained (Step S106). When determining that the measurement suspension command has been obtained (Step S106: YES), the controller 40 suspends the measurement of the elapsed time with the elapsed time measured so far kept (Step S116). Then, the controller 40 returns to Step S106.

On the other hand, when determining that the measurement suspension command has not been obtained (Step S106: NO), the controller 40 determines whether a measurement resumption command has been obtained (Step S107). When determining that the measurement resumption command has been obtained (Step S107: YES), the controller 40 returns to Step S105.

The measurement suspension command and the measurement resumption command, which can be detected in Step S106 and Step S107, respectively, are a predetermined measurement command(s) in this embodiment, and in response to these, the measurement is suspended and resumed in Step S116 and Step S105, respectively.

On the other hand, when determining that the measurement resumption command has not been obtained (Step S107: NO), the controller 40 determines whether a measurement stop command has been obtained (Step S108). When determining that the measurement stop command has been obtained (Step S108: YES), the controller 40 stops the measurement (Step S118). The controller 40 causes the display unit 55 to display the measurement result (by changing screens, for example) for a predetermined time, and then returns to Step S102.

On the other hand, when determining that the measurement stop command has not been obtained (Step S108: NO), the controller 40 determines whether a timer value change command (second change command) has been obtained (Step S109).

When determining that the timer value change command has been obtained (Step S109: YES), the controller 40 changes (extends or reduces) the current timer value (thereby extending or reducing the remaining time to be measured) by a predetermined time (10 seconds, in the above example) (Step S119).

The controller 40 stores the command-obtained timing and the changed content in the timer measurement change record 422. Then, the controller 40 proceeds to Step S121.

On the other hand, when determining that the timer value change command has not been obtained (Step S109: NO), the controller 40 determines whether a setting skip command (first change command), namely, a command to change the remaining time to be measured for the timer value to zero, has been obtained (Step S110).

When determining that the setting skip command has been obtained (Step S110: YES), the controller 40 stores the command-obtained timing and the elapsed time measured by this command-obtained timing in the timer measurement change record 422. Then, the controller 40 proceeds to Step S122.

On the other hand, when determining that the setting skip command has not been obtained (Step S110: NO), the controller 40 proceeds to Step S121.

In Step S121 after Step S110 or Step S119, the controller 40 determines whether the timer value has passed, namely, whether or not the elapsed time being measured is equal to or more than (i.e., has reached) the timer value of the currently selected time setting (Step S121).

When determining that the timer value has passed (Step S121: YES), the controller 40 proceeds to Step S122. On the other hand, when determining that the timer value has not passed (Step S121: NO), the controller 40 returns to Step S106.

In Step S122 after Step S110 or Step S121, the controller 40 determines whether the elapsed time has been measured for all the time settings of all the cycles (Step S122).

When determining that the elapsed time has been measured for all the time settings of all the cycles (Step S122: YES), the controller 40 causes the notifying unit 53 to perform a predetermined type of the notification processing, and finishes the measurement of the elapsed time (Step S124). Then, the controller 40 returns to Step S102.

In Step S102 after S124, when an initial value is set, the timer value(s) changed during the timer measurement last time are all reset.

On the other hand, when determining that the elapsed time has not been measured for all the time settings of all the cycles yet (Step S122: NO), the controller 40 causes the notifying unit to perform a type of the notification processing for (associated with) the task (i.e., name) set in the time setting for a predetermined time, switches/changes the set timer value to the timer value of the time setting next in order (switches the current time setting to the time setting next in order), and resets the elapsed time being measured (to zero) (Step S123). Then, the controller 40 returns to Step S106.

Steps S121 and S123 constitute a setting switching step (or setting switching process) of a timer measurement method (or program) according to this embodiment. Further, Steps S109, S111, S119 and S123 constitute a changing step (or changing process) thereof.

Figure 5:
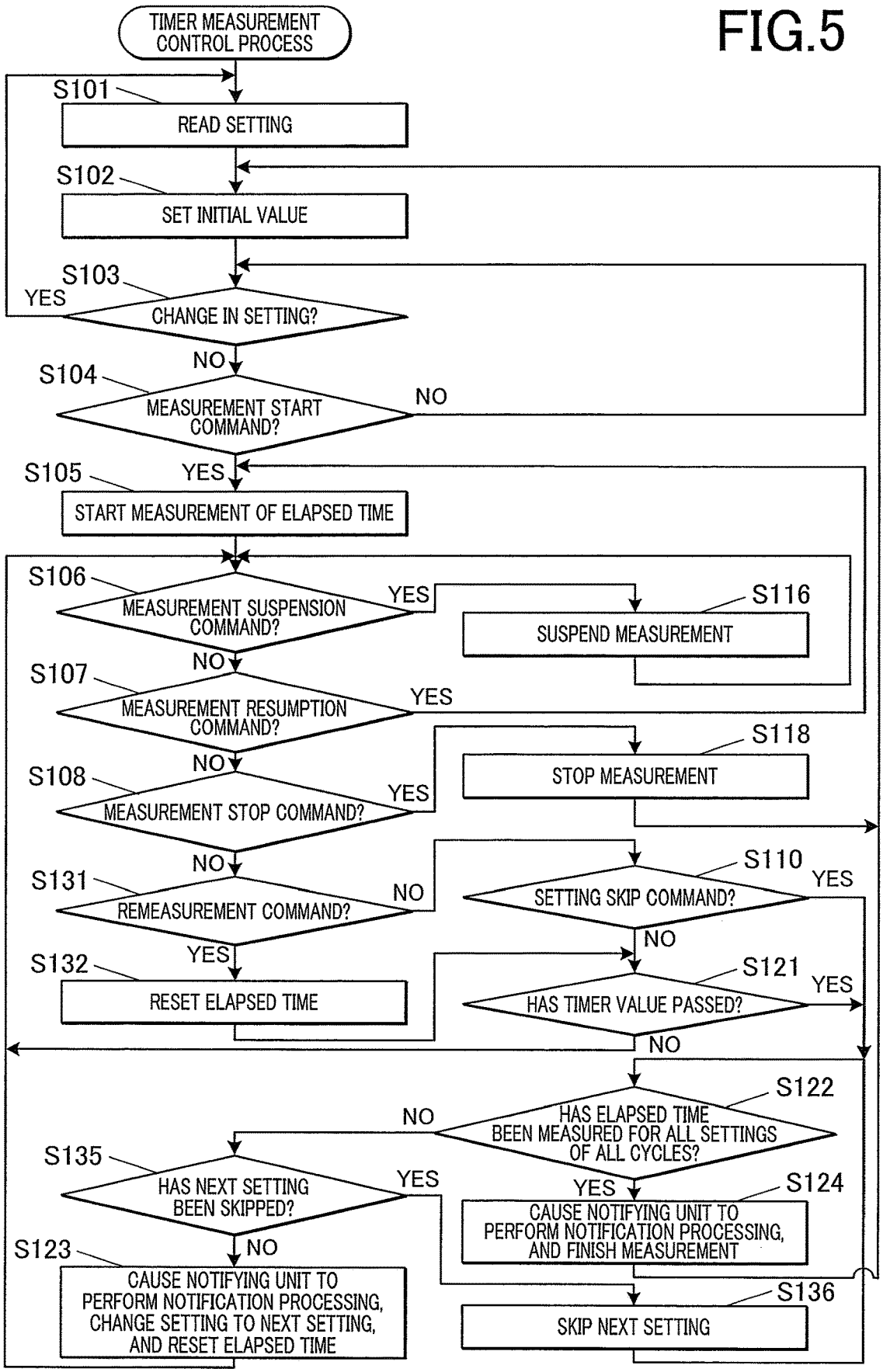
FIG. 5 is a flowchart showing a modification of the control procedure of the timer measurement control process.

FIG. 5 is a flowchart showing a modification of the control procedure by the controller 40 in the timer measurement control process performed in the electronic timepiece 1 of the embodiment.

The timer measurement control process of this modification is the same as the timer measurement control process of the embodiment except that Steps S109 and S119 in the embodiment are replaced by Steps S131 and S132, and Steps S135 and S136 are added. The same processing details are indicated by the same reference signs, and their detailed descriptions are not repeated here.

When determining in Step S108 that the measurement stop command has not been obtained (Step S108: NO), the controller 40 determines whether a remeasurement command (third change command) has been obtained (Step S131).

When determining that the remeasurement command has not been obtained (Step S131: NO), the controller 40 proceeds to Step S110.

On the other hand, when determining that the remeasurement command has been obtained (Step S131: YES), the controller 40 resets the elapsed time being measured to zero (Step S132).

That is, the controller 40 brings the remaining time to be measured for the current time setting back to the original timer value.

The controller 40 stores, in the timer measurement change record 422, time obtained by adding the original timer value (time stored in the timer measurement change record 422 before the elapsed time is reset this time if the elapsed time has been reset multiple times in the same time setting of the same cycle) to the elapsed time measured before being reset. Then, the controller 40 proceeds to Step S121.

When determination made in Step S122 is "NO", the controller 40 determines whether the next time setting has been skipped in accordance with Step S110 during the measurement of the elapsed time for this time setting in any of the previous cycles (Step S135).

When determining that the next time setting has not been skipped (Step S135: NO), the controller 40 proceeds to Step S123. On the other hand, when determining that the next time setting has been skipped (Step S135: YES), the controller 40 skips the next time setting (i.e., skips the measurement of the elapsed time for the time setting in which the remaining time has been changed to zero formerly) (Step S136).

After Step S136, the controller 40 returns to Step S122. After returning to Step S122, if the controller 40 proceeds to Step S135, the next time setting which the controller 40 makes determination in Step S135 is a time setting next to the skipped time setting.

Steps S109 and S119 in the embodiment and Steps S131 and S132 in the modification may coexist in the same timer measurement control process.

Further, Steps S109 and S119 in the embodiment and Steps S135 and S136 in the modification may coexist in the same timer measurement control process.

Still further, some of (i) Steps S109 and S119, (ii) Steps S131 and S132, and (iii) Steps S110, S135 and S136 may be omitted.

As described above, the electronic timepiece 1 (timer measurement device) of the embodiment includes the oscillator circuit 45 and the frequency divider circuit 46 which output a clock signal(s) of a predetermined frequency (frequencies); the controller 40; and the operation input unit 54 which receives an input operation(s).

The controller 40 stores, in the RAM 42, ordered time settings including at least their respective timer values as the timer setting information 421, and when the elapsed time that is measured by using the clock signal reaches a timer value included in a time setting selected from the time settings, resets the elapsed time, and switches the currently selected time setting to the next time setting among the ordered time settings.

If the operation input unit 54 receives a predetermined change command during the measurement of the elapsed time for the timer value of the currently selected time setting, the controller 40 performs, in response to the change command, the change processing which changes the remaining time with respect to the elapsed time for the timer value of the currently selected time setting.

Hence, if it is desired to change some of the timer values while the elapsed time is being measured for the timer values of the respective time settings in order (timer measurement), the timer value(s) can be properly changed with a simple operation(s) in the electronic timepiece 1, so that the measurement for the timer values can be performed with flexibility.

That is, the electronic timepiece 1 can easily adjust the timer values during the timer measurement, and this can increase user-friendliness.

Further, the controller 40 stores the number of measurement cycles for the time settings, and repeats the measurement of the elapsed time for the timer values of the time settings for the number of measurement cycles.

This enables easier management of multiple types of training, task processing or the like which are repeatedly performed in the order of arrangement of the timer values of the time settings, and also enables flexible management of the time settings according to user's condition, environment, and so forth in each time/cycle.

Further, during the measurement of the elapsed time for a time setting among the time settings, the measurement being performed for the number of measurement cycles, when switching the time setting to the change processing-performed time setting again, the controller 40 uses, as the timer value of the change processing-performed time setting, a timer value which corresponds to the elapsed time having been measured in accordance with the change processing.

That is, the timer setting(s) formerly changed can be used as it is in the following cycle(s). For example, if it is desired to reduce or extend time (i.e., timer value) of a specific type of training during the training, once its setting is changed, this changed setting can be maintained.

Meanwhile, at the time of the next training, the changed setting(s) is brought back to the original/basic setting(s). Hence, the reference state can be maintained. If the basic settings themselves need to be changed, they can be easily changed by an external device during no timer measurement. For this, on the basis of a predetermined user operation or the like, the timer measurement change record 422 may be displayed on the display unit 55, or output to the external device via the communication unit 52, so that the contents of the timer measurement change record 422 can be used as a reference to change the basic settings.

Further, the controller 40 changes the remaining time to zero in response to a first change command (setting skip command: Step S110) received during the measurement of the elapsed time for the currently selected time setting.

Thus, the measurement for a part of a timer value can be easily skipped during the measurement for the timer value. This can leave out unnecessary time when a skip thereof is desired.

Further, once the measurement for a timer value is skipped halfway as described above, during the measurement of the elapsed time for the time settings for the number of measurement cycles, the controller 40 skips the measurement of the elapsed time for the time setting which has been skipped.

Thus, it can be set not to deal with the formerly skipped time setting repeatedly.

That is, it is unnecessary thereafter to deal with anything for a task which becomes unnecessary halfway or a task which becomes difficult to perform halfway, and the measurement of the elapsed time for the time settings for the other tasks with the above task(s) omitted can be continued.

Hence, separate timer setting information does not need to be set, and a schedule of tasks can be changed easily and flexibly.

Further, the controller 40 changes the remaining time by a predetermined time in response to a second change command (timer value change command: Step S109) received during the measurement of the elapsed time for the currently selected time setting. Hence, if it is desired to change the speed or amount of a specific task (e.g., training load) due to the situation, this can be easily done with a simple change operation (input operation) to temporarily reduce or extend a timer value.

Further, the controller 40 brings the remaining time back to the original timer value of the currently selected time setting in response to a third change command (remeasurement command: Step S131) received during the measurement of the elapsed time for the currently selected time setting. That is, if it is desired to redo a task which is being performed, the measurement for its timer value only can be reset easily, and can be performed again. Further, for example, in a case where the last task took somewhat longer than its timer value, if the above operation (i.e., third change command) is made when the next task is started, it saves efforts of making an input operation(s) during the tasks. That is, the elapsed time being measured can be adjusted with a simple operation between tasks.

Further, the electronic timepiece 1 includes the notifying unit 53 which performs the notification processing, and the time settings each include identification information (name, in the embodiment), and when the elapsed time being measured reaches the timer value of the currently selected time setting, the controller 40 causes the notifying unit 53 to perform the notification processing for the identification information included in the currently selected time setting.

Thus, the type of the notification processing is changed according to the type of the time setting. Hence, a user can confirm a task which he/she has done. Further; because different types of the notification processing are performed for different tasks, the timer values for the respective tasks can be easily adjusted. This enables more flexible and effective timer measurement based on a series of time settings.

Further, the controller 40 suspends or resumes the measurement of the elapsed time in response to a predetermined measurement command received by the operation input unit 54. That is, not only the change processing to change the time being measured described above but also suspension of the measurement itself is available. Hence, if it is desired to suspend a task itself, for example, to suspend running due to a stop signal or the like, this can be easily and properly dealt with.

Further, the electronic timepiece 1 includes the communication unit 52 which communicates with an external device, and the controller 40 can obtain the time settings from the external device via the communication unit 52.

The contents of the time settings stored in the timer setting information 421 are complicated against an area which can be operated by the operation input unit 54 in an electronic watch or an area where display is available by the display unit 55 therein. Hence, the electronic timepiece 1 which obtains the time settings that are easily generated by an external device can increase usability of the time settings. Meanwhile, taking out the external device for fine adjustment of these time settings during the measurement of the elapsed time disturbs proper execution of tasks. Hence, the electronic timepiece 1 is configured to perform the partial adjustment of the time settings easily without using such an external device. This enables more flexible and proper measurement of the elapsed time based on a series of time settings.

The electronic timepiece 1 of the embodiment includes: the functional configuration as the timer measurement device described above; the time measurement circuit 47 which measures a date and time based on the clock signal; and the display unit 55, and the controller 40 can cause the display unit 55 to display the current date and time based on the date and time measured by the time measurement circuit 47.

That is, the electronic timepiece 1 has the functions as the timer measurement device, and hence can perform flexible timer measurement without having an additional device, which is necessary for an ordinary-use timepiece to perform the same.

The timer measurement method of the embodiment includes: when the elapsed time that is measured by using the clock signal reaches a timer value included in a time setting selected from the time settings, resetting the elapsed time, and switching the currently selected time setting to the next time setting among the ordered time settings; and if the operation input unit 54 receives a predetermined change command during the measurement of the elapsed time for the timer value of the currently selected time setting, performing, in response to the change command, the change processing which changes the remaining time with respect to the elapsed time for the timer value of the currently selected time setting.

Hence, if it is desired to change some of the timer values while the elapsed time is being measured for the timer values of the respective time settings in order, the timer values) can be properly changed with a simple operation(s), so that the measurement for the timer values can be performed with flexibility. That is, the timer measurement method can easily adjust the timer values during the timer measurement, and this can increase user-friendliness.

Further, the program(s) 511 for the above timer measurement method is installed in a computer of the electronic timepiece 1 to be performed. This enables easy and flexible adjustment of the time settings used in the timer measurement by software process, and accordingly enables timer measurement having higher user-friendliness and usefulness.

The above embodiment and the like are merely examples, and not intended to limit the above description. The above embodiment and the like can be modified in a variety of respects.

For example, in the embodiment and the like, as the change processing which changes the remaining time in response to a change command, some examples are described, which include: changing the remaining time directly; changing a timer value; and changing the elapsed time. Alternatively, the change processing may be one of these. Further, combinations of the processing details of the change processing and the targets of the change processing may be set differently from those described in the above embodiment and the like.

Further, the timing of storing a changed time setting in the timer measurement change record 422 is not limited to the timing of detecting its change command, and may be the timing after the elapsed time for the time setting targeted by the change command reaches the timer value (e.g., timing of Step S123).

Further, in the embodiment and the like, examples of the change command are described, which include: the command to change a timer value by a predetermined time; the command to skip the measurement of the remaining time; and the command to reset the elapsed time. However, as far as the change command is a command to change the original timer value of a time setting to another, it is not limited. For example, there may be a change command to extend or reduce a timer value (remaining time) by time corresponding to time of pressing a push-button switch, time of touching a predetermined point on a touchscreen, or the like. Further, there may be a change command to extend or reduce a timer value not in units of time but by percentage or the like, for example, a change operation (i.e., change command) to extend a timer value by 10% at the time of running against wind.

Further, in the embodiment and the like, the measurement for the timer values is performed for a plurality of cycles (the number of measurement cycles being two or more). Alternatively, the measurement for the timer values may be performed for one cycle only.

Further, in the embodiment and the like, the change processing to change a time setting of the timer function, which an electronic timepiece has, is described. The device to which the above embodiment and the like is applied, however, does not need to be an electronic device having functions as an electronic timepiece, and may be a timer measurement device which performs the timer measurement only, or an electronic device having other functions, such as a stopwatch function.

Further, in the embodiment and the like, the electronic timepiece 1 (timer measurement device) performs various types of the notification processing when the elapsed time being measured reaches the timer values. Alternatively, the timer measurement device may simply measure the elapsed time and display the measurement state. Still alternatively, the timer measurement device may output a predetermined notification signal to an external device instead of itself performing the notification processing. Yet further, the timer measurement device may be capable of performing only one type of the notification processing. Further, in the embodiment and the like, the identification information (names, in the embodiment) to be associated with (types of) the notification processing can be set and stored. Alternatively, the timer values may simply be set and stored in order if the identification information cannot be set.

Further, the type of the notification processing to be performed may be determined not according to the type of the time setting for which the elapsed time has been measured but according to the type of the time setting for which the elapsed time is about to be measured. This lets a user promptly recognize the next task.

Further, in the embodiment and the like, the time settings (contents of the timer setting information 421) used in the timer measurement can be obtained from an external device. Alternatively, the time settings may be obtained only by being generated by the timer measurement device itself.

Further, in the embodiment and the like, the contents of the timer setting information 421 are always obtainable. Alternatively, they may not be obtainable during the timer measurement processing. Further, obtained data from the outside may be stored somewhere, and the timer setting information 421 may be updated after the timer measurement. In these cases, the CPU 41 does not need to read and keep all the contents of the timer setting information 421 during the timer measurement processing, but should refer to the timer setting information 421 as needed.

In the above, as a computer readable medium storing the program(s) 511 for the timer measurement control process, the ROM 51 constituted of a mask ROM and/or a nonvolatile memory, such as a flash memory, is described. The computer readable medium, however, is not limited thereto. The computer readable medium may be a hard disk drive (HDD) or a portable recording medium, such as a CD-ROM or a DVD. Further, as a medium to provide data of the programs of the above embodiment and the like via a communication line, a carrier wave may be used.

The specific details of the configurations/components, control procedure, display examples, and so forth described in the embodiment and the like can be appropriately modified without departing from the scope of the present invention.

In the above, one or more embodiments have been described. However, the scope of the present invention is not limited thereto, and includes the scope of claims below and the scope of their equivalents.

What is claimed is:

1. A timer measurement device comprising:

a signal output unit which outputs a clock signal of a predetermined frequency;

an operation input unit which receives an input operation; and a processor configured to:

store ordered time settings including at least respective timer values;

store a number of measurement cycles for the time settings;

when an elapsed time that is measured by using the clock signal reaches a timer value included in a time setting selected from the time settings, reset the elapsed time, and switch the currently selected time setting to a next time setting among the ordered time settings;

repeat the measurement of the elapsed time for the timer values of the time settings for the number of measurement cycles; and when the operation input unit receives a predetermined change command during the measurement of the elapsed time for the timer value of the currently selected time setting, perform, in response to the change command, a change processing which changes a remaining time with respect to the elapsed time for the timer value of the currently selected time setting, wherein, during the measurement of the elapsed time for a change processing-performed time setting, the change processing-performed time setting being a time setting among the time settings with respect to which the change processing was performed, the processor is configured to use, as the timer value of the change processing-performed time setting measured in a measurement cycle subsequent to a measurement cycle in which the change processing was performed, a timer value which corresponds to the elapsed time having been measured in accordance with the change processing.

2. The timer measurement device according to claim 1, wherein the processor is configured to change the remaining time to zero in response to a first change command as the predetermined change command received during the measurement of the elapsed time for the currently selected time setting.

3. The timer measurement device according to claim 1, wherein the processor is configured to:

change the remaining time to zero in response to a first change command as the predetermined change command received during the measurement of the elapsed time for the currently selected time setting; and during the measurement of the elapsed time for the time settings for the number of measurement cycles, skip the measurement of the elapsed time for the time setting for which the remaining time has been changed to zero in response to the first change command.

4. The timer measurement device according to claim 1, wherein the processor is configured to change the remaining time by a predetermined time in response to a second change command as the predetermined change command received during the measurement of the elapsed time for the currently selected time setting.

5. The timer measurement device according to claim 1, wherein the processor is configured to bring the remaining time back to the timer value of the currently selected time setting in response to a third change command as the predetermined change command received during the measurement of the elapsed time for the currently selected time setting.

6. The timer measurement device according to claim 1, further comprising a notifying unit which performs a notification processing, wherein:

the time settings each include identification information, and the processor is configured to, when the elapsed time being measured reaches the timer value of the currently selected time setting, cause the notifying unit to perform the notification processing for the identification information included in the currently selected time setting.

7. The timer measurement device according to claim 1, wherein the processor is configured to suspend or resume the measurement of the elapsed time in response to a predetermined measurement command received by the operation input unit.

8. The timer measurement device according to claim 1, further comprising a communication unit which communicates with an external device, wherein the processor is configured to obtain the time settings from the external device via the communication unit.

9. An electronic timepiece comprising:

the timer measurement device according to claim 1;

a time measurement unit which measures a date and time based on the clock signal; and a display unit, wherein the processor is configured to cause the display unit to display a current date and time based on the date and time measured by the time measurement unit.

10. A timer measurement method which is performed by a timer measurement device including: a signal output unit which outputs a clock signal of a predetermined frequency; a memory which stores (i) ordered time settings including at least respective timer values and (ii) a number of measurement cycles for the time settings; and an operation input unit which receives an input operation, the timer measurement method comprising:

when an elapsed time that is measured by using the clock signal reaches a timer value included in a time setting selected from the time settings, resetting the elapsed time, and switching the currently selected time setting to a next time setting among the ordered time settings;

repeating the measurement of the elapsed time for the timer values of the time settings for the number of measurement cycles;

when the operation input unit receives a predetermined change command during the measurement of the elapsed time for the timer value of the currently selected time setting, performing, in response to the change command, a change processing which changes a remaining time with respect to the elapsed time for the timer value of the currently selected time setting; and during the measurement of the elapsed time for a change processing-performed time setting, the change processing-performed time setting being a time setting among the time settings with respect to which the change processing was performed, using, as the timer value of the change processing-performed time setting measured in a measurement cycle subsequent to a measurement cycle in which the change processing was performed, a timer value which corresponds to the elapsed time having been measured in accordance with the change processing.

11. The method according to claim 10, further comprising changing the remaining time to zero in response to a first change command as the predetermined change command received during the measurement of the elapsed time for the currently selected time setting.

12. The method according to claim 10, further comprising:

changing the remaining time to zero in response to a first change command as the predetermined change command received during the measurement of the elapsed time for the currently selected time setting; and during the measurement of the elapsed time for the time settings for the number of measurement cycles, skipping the measurement of the elapsed time for the time setting for which the remaining time has been changed to zero in response to the first change command.

13. The method according to claim 10, the timer measurement device further including a notifying unit which performs a notification processing, the time settings each including identification information, and the method further comprising, when the elapsed time being measured reaches the timer value of the currently selected time setting, causing the notifying unit to perform the notification processing for the identification information included in the currently selected time setting.

14. The method according to claim 10, further comprising suspending or resuming the measurement of the elapsed time in response to a predetermined measurement command received by the operation input unit.

15. A non-transitory computer readable storage medium storing a program which is performed by a computer including: a signal output unit which outputs a clock signal of a predetermined frequency; a memory which stores (i) ordered time settings including at least respective timer values and (ii) a number of measurement cycles for the time settings; and an operation input unit which receives an input operation, the program causing the computer to:

when an elapsed time that is measured by using the clock signal reaches a timer value included in a time setting selected from the time settings, reset the elapsed time, and switch the currently selected time setting to a next time setting among the ordered time settings;

repeat the measurement of the elapsed time for the timer values of the time settings for the number of measurement cycles;

when the operation input unit receives a predetermined change command during the measurement of the elapsed time for the timer value of the currently selected time setting, perform, in response to the change command, a change processing which changes a remaining time with respect to the elapsed time for the timer value of the currently selected time setting; and during the measurement of the elapsed time for a change processing-performed time setting, the change processing-performed time setting being a time setting among the time settings with respect to which the change processing was performed, using, as the timer value of the change processing-performed time setting measured in a measurement cycle subsequent to a measurement cycle in which the change.

16. The computer readable storage medium according to claim 15, the program further causing the computer to change the remaining time to zero in response to a first change command as the predetermined change command received during the measurement of the elapsed time for the currently selected time setting.

17. The computer readable storage medium according to claim 15, the program further causing the computer to:

change the remaining time to zero in response to a first change command as the predetermined change command received during the measurement of the elapsed time for the currently selected time setting; and during the measurement of the elapsed time for the time settings for the number of measurement cycles, skip the measurement of the elapsed time for the time setting for which the remaining time has been changed to zero in response to the first change command.

18. The computer readable storage medium according to claim 15, the computer further comprising a notifying unit which performs a notification processing, the time settings each including identification information, and the program further causing the computer to, when the elapsed time being measured reaches the timer value of the currently selected time setting, cause the notifying unit to perform the notification processing for the identification information included in the currently selected time setting.

19. The computer readable storage medium according to claim 15, the program further causing the computer to suspend or resume the measurement of the elapsed time in response to a predetermined measurement command received by the operation input unit.

* * * * *